US006483689B1

(12) United States Patent
Koch et al.

(10) Patent No.: US 6,483,689 B1
(45) Date of Patent: Nov. 19, 2002

(54) METHOD FOR THE OPERATION OF AN ELECTROMAGNETIC SERVO MECHANISM

(75) Inventors: Achim Koch, Tegernheim (DE); Hanspeter Zink, Regensburg (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/529,634

(22) PCT Filed: Sep. 2, 1998

(86) PCT No.: PCT/DE98/02599

§ 371 (c)(1),
(2), (4) Date: Nov. 27, 2000

(87) PCT Pub. No.: WO99/19615

PCT Pub. Date: Apr. 22, 1999

(30) Foreign Application Priority Data

Oct. 15, 1997 (DE) ..... 197 45 536

(51) Int. Cl.[7] ..... H01H 9/00
(52) U.S. Cl. ..... 361/160; 361/152
(58) Field of Search ..... 361/160, 152

(56) References Cited

U.S. PATENT DOCUMENTS

| | | | | |
|---|---|---|---|---|
| 4,029,068 A | | 6/1977 | Jones et al. | 123/139 |
| 5,650,909 A | | 7/1997 | Remele et al. | 361/154 |
| 5,671,705 A | | 9/1997 | Matsumoto et al. | 123/90.11 |
| 6,016,778 A | * | 1/2000 | Koch | 123/90.11 |

FOREIGN PATENT DOCUMENTS

| | | | |
|---|---|---|---|
| DE | 36 09 599 | 9/1987 | H01F/7/18 |
| DE | 44 34 684 | 4/1996 | H01F/7/18 |
| DE | 195 26 683 | 1/1997 | H01F/7/18 |
| EP | 0 376 716 | 7/1990 | F01L/9/04 |
| EP | 0 711 910 | 5/1996 | F02D/41/20 |
| EP | 0 724 067 | 7/1996 | F01L/9/04 |
| JP | 07 322 044 | 6/1994 | F01L/9/04 |

OTHER PUBLICATIONS

"Verlustarme Ansteuerung von Aktuatoren" Herbert Sax, Electroni 23. Nov. 13, 1987.

* cited by examiner

*Primary Examiner*—Stephen W. Jackson

(57) ABSTRACT

The servo mechanism has an adjuster (12) and a driver (11). The driver has at least one electromagnet with a coil (113), a movable armature plate (117) and at least one spring (118*a*, 118*b*) which biases the armature plate toward a given rest position (R). A deceleration field is produced by the coil while the armature plate is moving away from the coil, and does so for a given period of time (T2).

Figure 1:
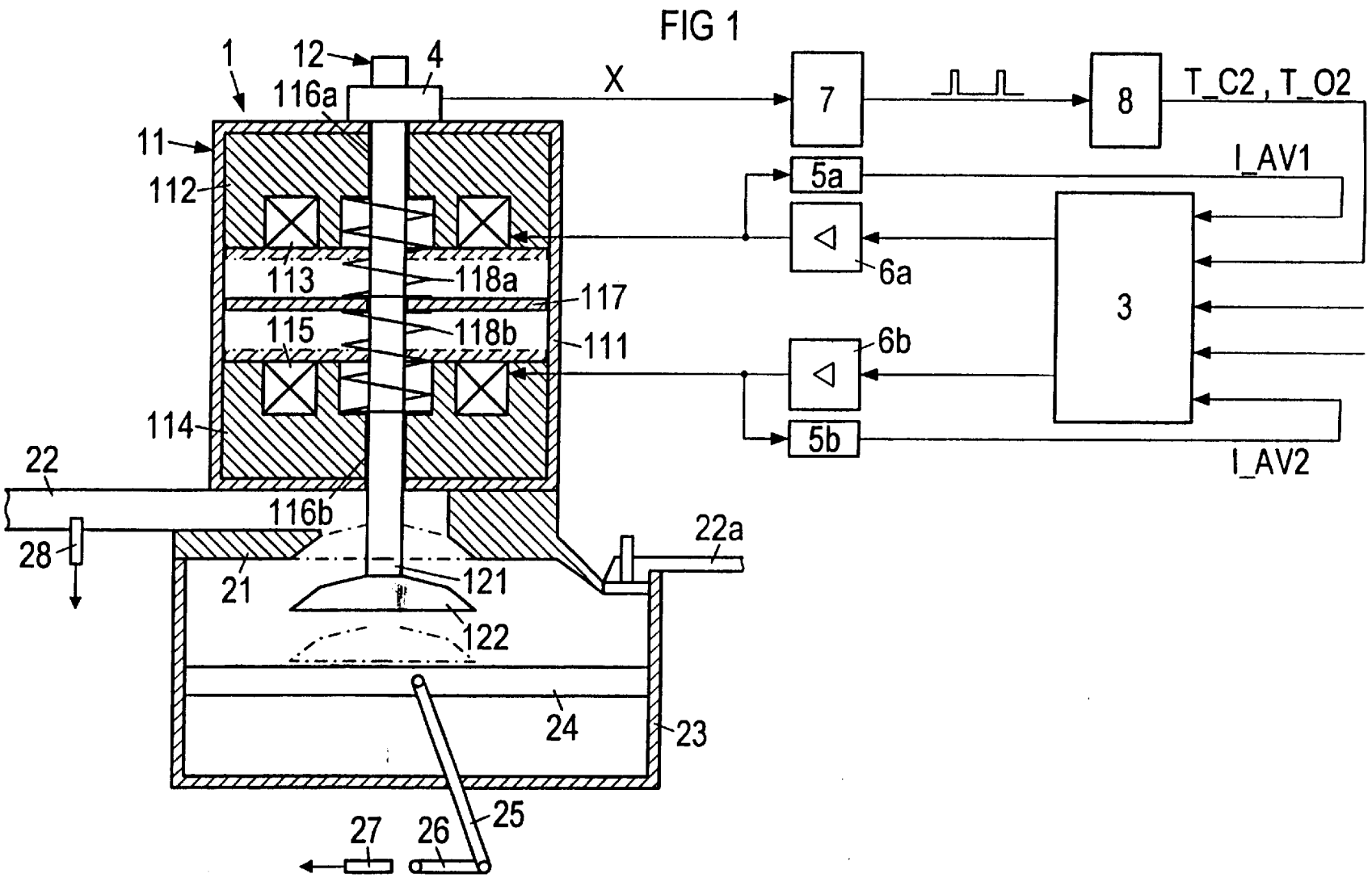

10 Claims, 4 Drawing Sheets t
$U_{S11}$
$U_{S12}$
$U_{S21}$
$U_{S22}$
I_F
I_B
I_H
I_N
I_AV1
I_AV2
$t_1$
$t_2$
$t_3$
$t_4$
$t_5$
$t_8$
$t_9$
T1
T2
T0
X
C
K4
K3
R
K2
K1
O
T_C2
T_O2

METHOD FOR THE OPERATION OF AN ELECTROMAGNETIC SERVO MECHANISM

The invention relates to the operation of an electromagnetic servo mechanism according to the preamble of claim 1. It relates especially to a servo mechanism for operating an internal combustion engine.

A known servo mechanism (DE 195 26 683 A1) has a correcting element in the form of a gas reversal valve, and a servo driver. The servo driver has two electromagnets between which an armature plate can be moved against the force of a restoring means by shutting off the coil current at the holding electromagnet and turning on the coil current at the capturing electromagnet. The coil current of the capturing electromagnet is kept constant at a given capture current during a given period of time and is then adjusted by a two-point controller with hysteresis to a holding current until the coil current is shut off.

Manufacturing variations and departures from the given arrangement of the components of the servo driver, especially the restoring means, bring it about that the rest position established by the restoring means is not symmetrical with the contact surfaces on the electromagnets. Thus a strong impact of the armature plate against an electromagnet can occur when the armature plate is driven by the one electromagnet to the other. The impact produces a loud noise.

Ever more stringent legal limits are established for the production of noise by a motor vehicle and the demand for a quietly running internal combustion engine make it essential, if the servo mechanism is to be produced in series, that the noise produced by the servo mechanism be as low as possible.

The invention is addressed to the problem of creating a method for operating a servo mechanism which will reduce the production of noise when an armature plate impacts an electromagnet.

The problem is solved by the features of claim 1. The solution is characterized by the fact that, while the deceleration rate is established as a set value for the current, a deceleration field is produced by the current and generates a force opposed to the acceleration force which acts upon the armature plate. The acceleration force is produced by the tension of the springs. The deceleration force field reduces the impact velocity of the armature plate. The solution moreover has the advantage of reducing wear on the servo driver.

In advantageous embodiments of the invention, the time period T2 depends on the rotational speed and a load factor or on the velocity of the armature plate, or the amount of deceleration depends on the rotational speed and the load factor or the velocity of the armature plate. This makes possible a selective, asymmetrical adjustment of the rest position of the armature plate, without increasing the noise production when the servo mechanism is operated. This is especially desirable if the servo is an exhaust valve, since it has to be opened against the exhaust gas pressure in the cylinder.

Additional advantageous embodiments of the invention are specified in the subordinate claims.

Figure 4:
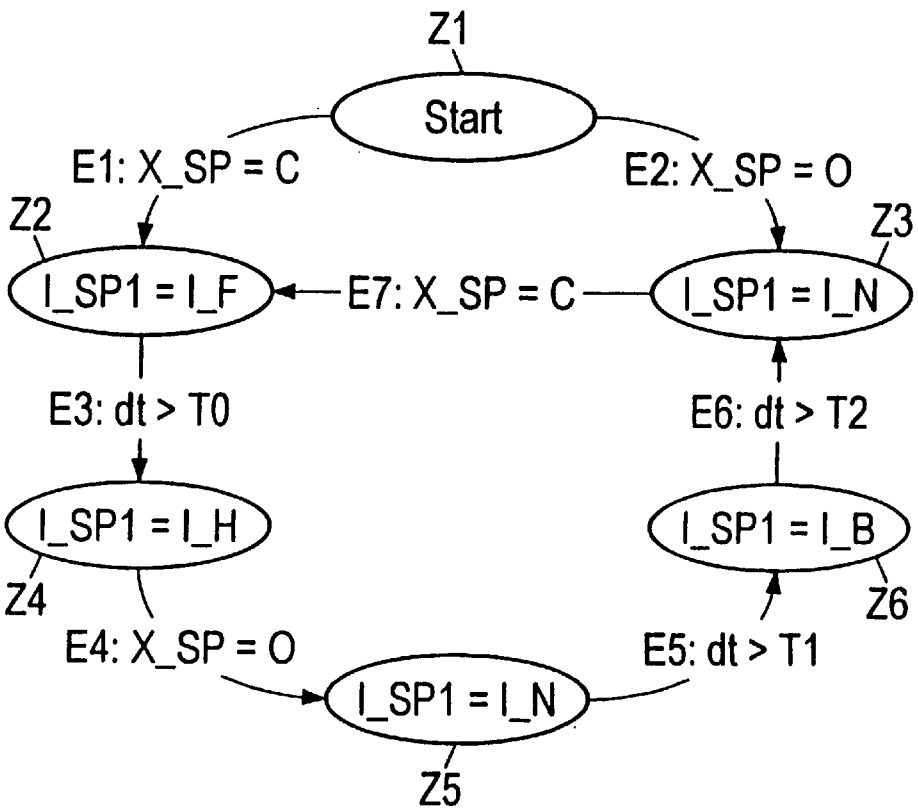
Figure 2:
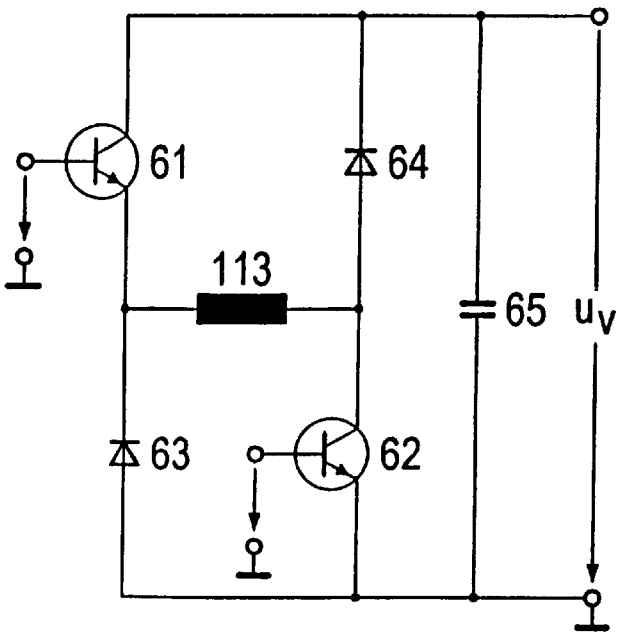
Figure 3:
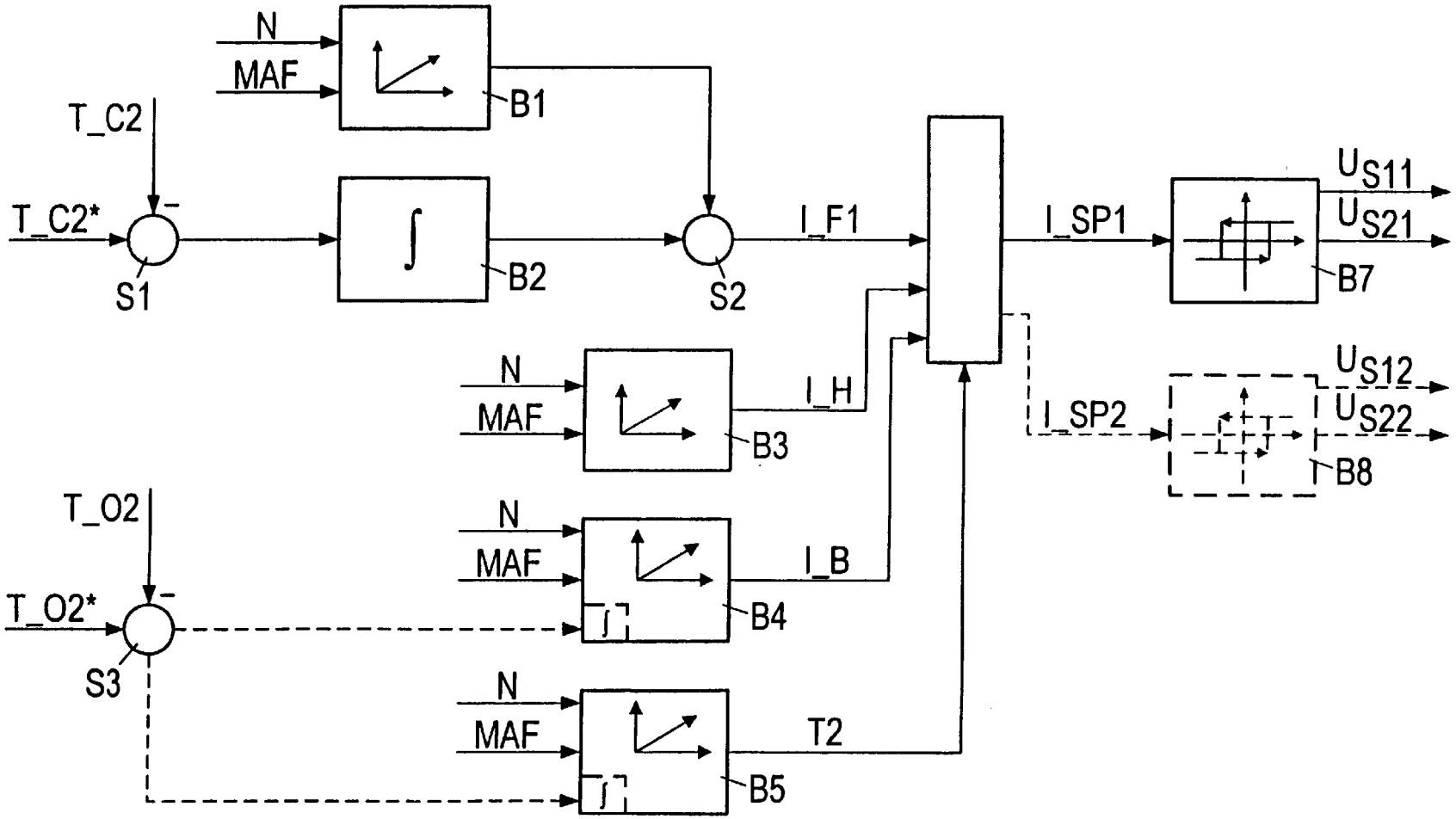

Embodiments of the invention are explained with the aid of the schematic drawings, wherein:

FIG. 1 shows an arrangement of a servo mechanism in an internal combustion engine, FIG. 2 a circuit of the driver of the servo mechanism, FIG. 3 a block diagram of a control system for controlling the servo mechanism, FIG. 4 a diagram of the state of block B6 of the servo mechanism, FIGS. 5*a–e* the timing of the control voltages, the current through the first and second coil, the position of the armature plate and a signal put out by a comparator system 7.

Elements of equal construction and operation are provided with the same reference symbols throughout the figures.

A servo mechanism 1 (FIG. 1) comprises a servo driver 11 and an adjuster 12 which is in he form, for example, of a gas-reversing valve and has a shaft 121 and a valve head 122. The servo driver 11 has a housing 111 in which a first and second electromagnet are disposed. The first electromagnet has a first core 112 in which a first coil 113 is embedded in an annular groove. The second electromagnet has a second core 114 in which an additional coil 115 is embedded in an additional annular groove. The first core 112 has an opening 116*a* forming a guide for the shaft 121. The second core 114 has an additional opening 116 which also serves as a guide for the shaft 121. An armature plate 117 is disposed for movement in the housing 111 between the first core 112 and the second core 114. A first spring 118*a* and a second spring 118*b* bias the armature plate 117 toward a given rest position R.

The servo mechanism 1 is affixed to a cylinder head 21. An intake passage 22, an exhaust passage 22*a* and a cylinder with a piston 24 are associated with the cylinder head. The piston 24 is coupled to a crankshaft 26 by a connecting rod 25.

A control system 3 is provided which detects signals from sensors and produces the positioning signals for the servo mechanism 1. The sensors are: a position pickup which detects a position X of the armature plate 117, a first current meter 5*a* which detects the actual value I_AVI of the current through the first coil 112, a second current meter 5*b* which detects an actual value I_AV2 of the current through the second coil, an RPM pickup 27 which detects the rotatory speed N of the crankshaft 26, or a load detecting sensor 28 which is preferably an air mass meter or a pressure sensor. Additional sensors may be present along with the sensors mentioned.

A comparator system 7 is provided which produces a pulse signal depending on the detected position X and given threshold values K1, K2, K3 and K4. The comparator system 7 has four analog threshold comparators each of which changes its output signal at one of the threshold values K1, K2, K3 and K4. By a logical linking up of the threshold value comparators the pulse signal of the comparator system recorded in Figure Sa is then formed. The threshold values K1, K2, K3 and K4 (FIG. 5*d*) are situated, for example, at the following relative spacing values which are related with the distance between the contact surface of the armature plate 117 in the first electromagnet and the contact surface of the armature plate 117 at the second electromagnet: K1 at 5%, K2 at 20%, K3 at 80% and K4 at 95%.

A timing circuit 8 (FIG. 1), which is configured preferably as a so-called "CAPCOM" unit, detects the duration of the pulse signal produced by the comparator system 7 and passes the times T_C2 and T_O2 to the control system 3 as digital data.

In first approximation, the time T_C2 is a measure of the average velocity of the armature plate between the threshold values K3 and K4. The time T_02 likewise obtained from the timing circuit is in first approximation a measure of the average velocity of the armature plate 117 between the threshold values K2 and K1

Drivers 6*a* and 6*b* are provided, which amplify the actuating signals of the control system 3. A circuit (FIG. 2) of the drivers 6*a* and 6*b* has a first transistor 61 whose base is connected to an output of the control system 3 and at which the voltage signal $U_{S11}$ is present. Also, the circuit has a second transistor 62 whose base is connected to the control system 3 and at which the voltage signal $U_{S21}$ is present. The circuit furthermore has a first diode 63, a second diode 64 and a condenser 65.

If a high voltage level is present at the base terminal of the first transistor 61, the first transistor 61 becomes conductive from the collector to the emitter. If additionally a high voltage level is present at the base terminal of the second transistor 62, the second transistor 62 also becomes conductive. At the first coil 113, the supply voltage $U_V$ approximately decreases. The current I_AV1 through the coil 113 then increases until the total supply voltage $U_V$ at the internal resistance of the first coil 113 decreases. If then a low voltage level is preset at the base terminal of the first transistor 61, transistor 61 blocks and the diode 63 becomes conductive as a free-wheeling diode. The current I_AVI through the coil then decreases. The raising and lowering of the level of the voltage signal $U_{S11}$ results in a two-point regulation of the current I_AV1 through the coil.

If both the level of the voltage signal $U_{S11}$ and the level of the voltage signal $U_{21}$ are switched from high to low, then both the first diode 63 and the second diode 64 become conductive and the current through the first coil 113, driven by the charge of the condenser 75, is reduced much more rapidly than if free-wheeling is performed only through the first diode 63. Thus a very fast reduction of the current I_AV1 through the first coil 113 is assured.

The circuit of the driver 6*b* is similar to the circuit represented in FIG. 2. It differs only in that the voltage signal $U_{S12}$ is present at the base terminal of the first transistor 61 and the voltage signal $U_{S22}$ is present at the base terminal of the second transistor 62, and that the emitter of the first transistor 61 and the collector of the second transistor 62 are conductively connected to the second coil 115.

FIG. 3 shows a block diagram of the control system 3 for controlling the electromechanical servo mechanism 1. In a block B1 a capture value I_F1 is obtained from an identification field, in accordance with the rotatory speed N and the air mass flow MAF. The values of the identification field are obtained at a motor test stand or by simulations such that heat losses in the particular coil are low.

At a summation point S1 the difference between the set value T_C2* and the actual duration T_C2 is computed. The set value T_C2* is permanent. However, it can alternatively be found from an identification field on the basis of at least one magnitude detected by the sensors. A block B2 comprises an integrator, which computes a corrective value dependent upon the difference between the set value T_C2* and the actual duration T_C2, with which the capture value I_F is corrected in the summation point S2. Thus allowance is made for influence by manufacturing variance and aging of the servo mechanism.

In a block B3 a holding value I_H is obtained from an identification field according to the speed N and the air mass flow MAF. In a block B4 a deceleration value is obtained from an identification field depending upon the speed N and the air mass flow MAF and/or upon the integral through the departure from the set value T_O2* and the actual duration T_O2. The set value T_O2* is permanently set. Alternatively, however, it can also be obtained from an identification field dependent upon at least one magnitude detected by the sensors.

In a block B5 the duration T2 is obtained from an identification field according to the speed N and the air mass flow and/or the integral of the difference between the set value T_O2* and the actual time T_O2.

In a block B6 it is determined whether the capture value I_F1, the holding value I_H, the deceleration value I_B or a null value I_N (e.g., null amperes) is given as the set value I_SP1 of the current for a regulator B7. The controlled variable of the controller B7 is the current through the first coil 113. The function of block B6 will be described below in connection with FIG. 4.

The difference between the set value I_SP1 obtained in block B6 and the actual value I_AV1 of the current through the first coil 113 is the controlled variable of the controller B7 configured as a two-point controller with hysteresis. The control variables of the controller B7 are the voltage signals $US_{S11}$ and $U_{S21}$.

In FIG. 3 there is shown by way of example the block circuit diagram for the computation of the control signals for the first coil 113. The computation of the control signals for the second coil, i.e., the voltage signals $U_{S12}$, $U_{S22}$, is performed similarly, only the time periods T_C2, T_C2*, are to be replaced are to be replaced by the time periods T_O2 and T_O2*. The initial magnitude of block B6 is then the set value I_SP2 of the current through the second coil 115, a controller B8, which is the same in construction as controller B7 has as its controlled magnitude the current through the second coil 115, and has as control variable the voltage signals $U_{S12}$ and $I_{S22}$.

FIG. 4 shows by way of example the diagram of the states of block B6 for the computation of the set value I_SP1 of the current through the first coil 113. A first state Z1 is the start from which the transition is made to a state Z2 when the condition E1 is fulfilled, namely that a set value $X_{13}$ SP of position X is equal to a closed position C of the armature plate 117. In this state Z2 the set value I_SP1 is the capture value I_F.

A transition to a state Z3 from state Z1 takes place if a condition E2 is fulfilled, namely that the set value X_SP of position X is equal to an open position O. In state Z3 the set value I_SP1 is equal to the null value I_N.

A transition from state Z2 to a state Z4 occurs when the time dt since the state Z2 was assumed is greater than a time T0. The time T0 is either permanently established or it is determined by the detection of the striking of the armature plate against the first electromagnet.

In state 24, the set value I_SP1 of the current through the first coil 113 is the holding value I_H. The transition from state Z4 to a state Z5 takes place when a condition E4, that the set value X_SP of the position X of the armature plate 117 is the open position O, is satisfied.

In the state Z5 the set value I_SP1 of the current through the first coil 113 is the null value I_N. A transition from state Z4 to a state Z6 takes place whenever the condition E5 is fulfilled, namely that the duration dt since state Z5 was assumed is greater than a time T1.

The time T1 is established such that a transition from state Z5 to state Z6 will not take place until the armature plate 117 starts to move away from the first electromagnet.

In state Z6 the set value I_SP1 of the current through the first coil 113 is the deceleration value I_B. The condition E6 for a transition from state Z6 to state Z3 is that the time dt since state Z6 was assumed is greater than the time T2. In state Z4 the set value I_SP1 of the current through the first coil 113 is the null value I_N. The condition E7 for the transition from state Z3 to state Z2 is that the set value X_SP of the position of the armature plate is equal to the closed position C.

The state diagram of block B6 for determining the set value I_SP2 of the current through the second coil 115 is the same as the state diagram of FIG. 4 with the difference that the closed position C is to be replaced by the open position O and vice versa, and that the set value I_SP1 is to be replaced by the set value I_SP2.

Figures 5A, 5B, 5C, 5D, 5E:
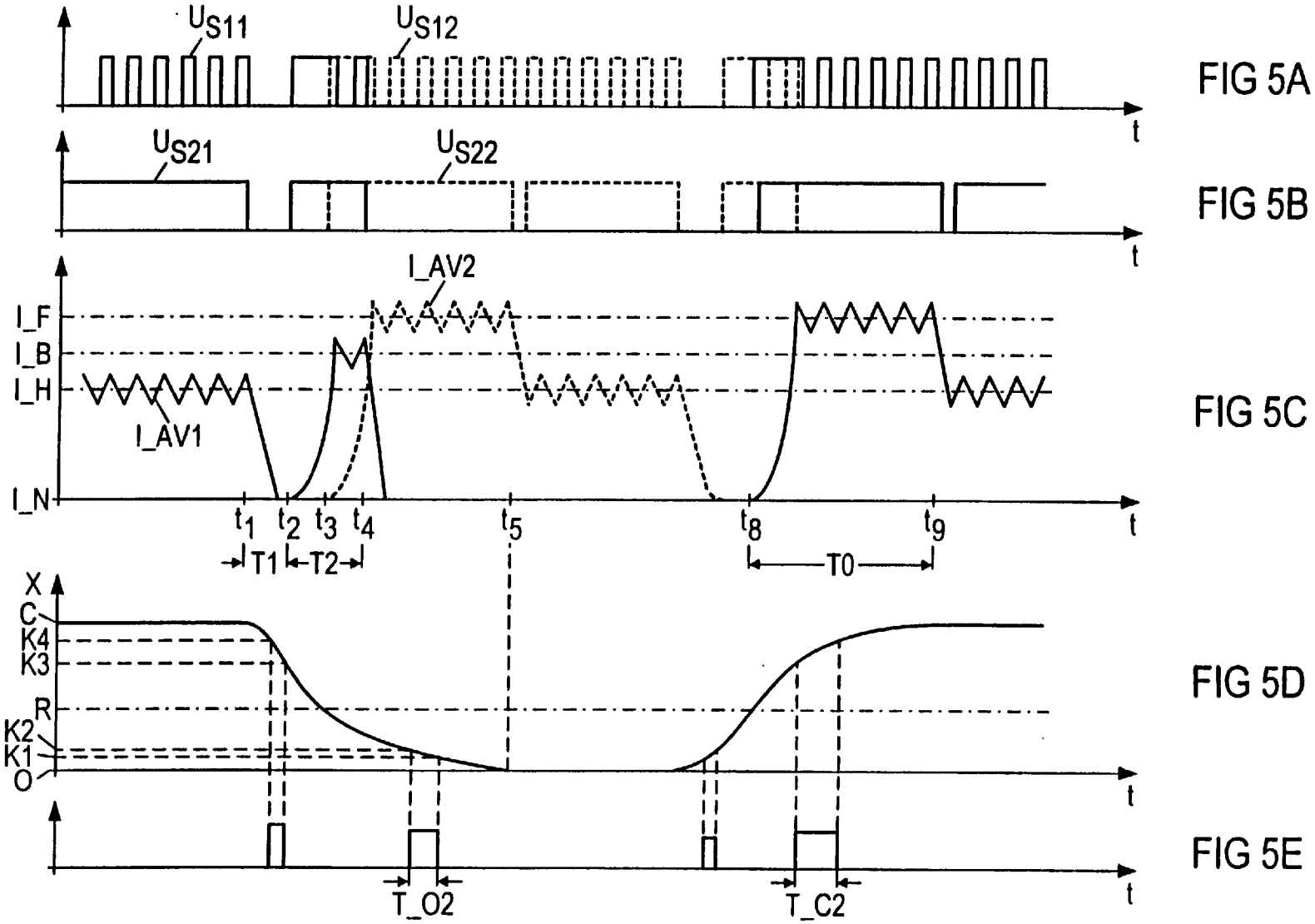

FIG. 5*a* shows the voltage signal $U_{S11}$ and the voltage signal $U_{S12}$ (dotted lines) recorded over the time t.

FIG. 5*c* shows the associated time curve of the actual value I_AV1 of the current through the first coil 113 and the time curve of the actual value I_AV2 (in broken lines) of the current through the second coil 115.

FIG. 5*d* shows the associated position X of the armature plate 117 plotted over the time t.

Up to a moment $t_1$, the set value of the current through the first coil 113 is the holding value I_H. The holding value I_H is made such that the force produced by the current through the first coil 113 against the armature plate 117 is sufficient to hold the armature plate in contact with the first electromagnet, and otherwise only slight heat losses occur.

At a moment $t_1$, the null value I_N for the duration T1 is given as the set value I_SP1 of the current through the first coil 113. At moment $t_1$, both the voltage signal $U_{S11}$ and the voltage signal $U_{S21}$ are set at a low level, so that the actual value of the current through the first coil drops very quickly to the null value I_N. After the end of the time T1 from the moment $t_1$, at a moment $t_2$ the deceleration value I_B is established as the set value of the current through the first coil 113, for the duration T2. When the duration T2 depends on the rotary speed and the load substitute value, preferably the air mass flow, the rest position R can be established out of symmetry with the contact surfaces of the armature plate on the two electromagnets. This is advantageous when the servo mechanism is configured as an exhaust valve, since the exhaust valve has to be driven during the transition from the closed position C to the open position O against the high pressure within the cylinder. The duration T1 is preferably selected such that the armature plate is still near to the closed position at the moment t2 (e.g., has covered just 3% of the distance between the closed and open position). Thus a very good decelerating action on the armature plate has been achieved.

Beginning at a moment $t_4$ the null value I_N is again given as the set value I_SP1 of the current through the first coil. After the moment $t_8$, the set value I_SP1 of the current through the first coil is the capture value I_F, for the duration T0.

At a moment $T_3$ the capture value I_F is given as the set value I_SP2 of the current through the second oil 115. The moment $t_3$ can also be subsequent to the moment $t_4$.

The corresponding movement of the position X of the armature plate shows that after the moment $t_1$ the armature plate at first remains in the closed position C and then moves with increasing velocity toward the open position O, until after the moment $t_2$ the acceleration of the armature plate 117 is reduced and at the moment $t_5$ the armature plate reaches the open position O.

The invention is not limited to the embodiment described. The method can be developed as a program of a microprocessor. But likewise it can also be achieved by a logic circuit or by an analog switching arrangement. The capture value I_F and/or the holding value I_H and/or the deceleration value I_B can also be fixedly established values.

The controller can also be configured, for example, as a one-point controller with a timing circuit or as a pulse-width modulation controller. An especially low propagation of noise by the servo mechanism is achieved if additionally the capture value I_F is reduced, for a period of time that depends on the difference between the set value T_C2*, T_O2* and the actual period of time T_C2, T_O2.

The capture value is, for example, eight amperes, the holding value three amperes, and the deceleration value ten amperes.

What is claimed is:

1. Method for controlling an electromechanical servo mechanism which has an adjuster (12) and a driver (11) which has a first electromagnet with a first coil (113), a second electromagnet with a second coil (115), first and a second springs (118*a*, 118*b*) which bias the armature plate (117) to a given rest position (R), and a controller (B7, B8) being associated with the plunger (121) for each coil, a control variable of which is the current through the coil (113, 115), with the following successive steps comprising:

establishing a holding value (I_H) as a set value of the current through a first one of the first and the second coils (113, 115) while the armature plate (117) rests in contact with a corresponding first one of the first and second electromagnets up to a moment of time (t1), establishing a null value (I_N) as the set value while the armature plate (117) moves away from the first one of the first and second electromagnets for a duration (T1), establishing a deceleration value (I_B) as the set value for a second duration (T2), and establishing the null value (I_N) as the set value.

2. Method according to claim 1, characterized in that a position pickup (4) to detect a position (X) of the armature plate (117) is provided, and that the first duration (T2) depends on the position (X).

3. Method according to claim 1, characterized in that the second duration (T2) depends on a rotary speed (N) and a load factor.

4. Method according to claim 1, characterized in that the deceleration value (I_B) depends on a rotary speed (N) and the load factor.

5. Method according to claim 3, characterized in that the load factor is air mass flow (MAF).

6. Method according to claim 1, characterized in that the second duration (T2) depends upon a velocity of the armature plate (117).

7. Method according to claim 1, characterized in that the deceleration value (I_B) depends on a velocity of the armature plate (117).

8. Method according to claim 6, characterized in that the velocity of the armature plate (117) is approximated by a period of time (T_O2, T_C2) which the armature plate (117) requires in order to pass from a first threshold value (K2, K3) of a position (X) to a second threshold value (K1, K4) of the position (X).

9. Method according to claim 4, characterized in that the load factor is air mass flow (MAF).

10. Method according to claim 7, characterized in that the velocity of the armature plate (117) is approximated by a period of time (T_O2, T_C2) which the armature plate (117) requires in order to pass from a first threshold value (K2, K3) of a position (X) to a second threshold value (K1, K4) of the position (X).

* * * * *